US008040341B2

(12) United States Patent
Lin

(10) Patent No.: US 8,040,341 B2
(45) Date of Patent: Oct. 18, 2011

(54) BRIGHTNESS CONTROL SYSTEM

(75) Inventor: Yung-Lin Lin, Palo Alto, CA (US)

(73) Assignee: O2Micro Inc, Santa Clara, CA (US)

( * ) Notice: Subject to any disclaimer, the term of this patent is extended or adjusted under 35 U.S.C. 154(b) by 499 days.

(21) Appl. No.: 10/754,987

(22) Filed: Jan. 9, 2004

(65) Prior Publication Data

US 2005/0151716 A1 Jul. 14, 2005

(51) Int. Cl.
*G09G 5/00* (2006.01)

(52) U.S. Cl. ..... 345/212; 345/77; 345/102

(58) Field of Classification Search ..... 345/76–102, 345/204–215
See application file for complete search history.

(56) References Cited

U.S. PATENT DOCUMENTS

| | | | | |
|---|---|---|---|---|
| 5,786,801 | A * | 7/1998 | Ichise | 345/102 |
| 6,271,813 | B1 * | 8/2001 | Palalau | 345/77 |
| 6,518,962 | B2 * | 2/2003 | Kimura et al. | 345/211 |
| 6,549,179 | B2 * | 4/2003 | Youngquist et al. | 345/39 |
| 6,762,741 | B2 * | 7/2004 | Weindorf | 345/102 |
| 6,812,649 | B2 * | 11/2004 | Kim | 315/149 |
| 6,850,209 | B2 * | 2/2005 | Mankins et al. | 345/1.3 |
| 7,095,392 | B2 * | 8/2006 | Lin | 345/87 |
| 2002/0118161 | A1 * | 8/2002 | Lin | 345/102 |
| 2004/0155853 | A1 * | 8/2004 | Lin | 345/102 |
| 2005/0012755 | A1 * | 1/2005 | Dresevic et al. | 345/581 |
| 2005/0057484 | A1 * | 3/2005 | Diefenbaugh et al. | 345/102 |
| 2005/0068332 | A1 * | 3/2005 | Diefenbaugh et al. | 345/604 |
| 2005/0134547 | A1 * | 6/2005 | Wyatt | 345/102 |
| 2007/0018941 | A1 * | 1/2007 | Moyer et al. | 345/102 |

FOREIGN PATENT DOCUMENTS

| | | |
|---|---|---|
| CN | 2420709 | 2/2001 |
| CN | 2446528 | 9/2001 |
| CN | 2554719 Y | 6/2003 |
| CN | 2554720 Y | 6/2003 |
| CN | 1614680 | 5/2005 |

OTHER PUBLICATIONS

English translation of Taiwan Office Action dated Dec. 5, 2005 received in corresponding Taiwan Patent Application No. 092140955 (3 pages).

English translation of Chinese Office Action dated Sep. 1, 2006 received in corresponding Chinese Patent Application No. 20050000560.8 (5 pages).

Partial English translation of Chinese Office Action issued in related Chinese Patent Application dated Feb. 1, 2008.

* cited by examiner

*Primary Examiner* — Vijay Shankar

(57) ABSTRACT

In one embodiment, the present disclosure provides a method to control the brightness of a display. One exemplary method includes generating a signal indicative of a display brightness level, and controlling the brightness of the display, based at least in part on the signal indicative of a display brightness level.

18 Claims, 20 Drawing Sheets

BRIGHTNESS CONTROL SYSTEM

FIELD

The present disclosure relates to a brightness control system. General utility for the present disclosure is for brightness control of LCD panel displays, plasma displays, field emission displays or light emitting diode displays such as may be associated with portable computers and portable DVD players and portable electronic devices, and/or stand-alone panel monitors and/or television displays.

BACKGROUND

FIG. 1 depicts a conventional computer system 100 having a conventional LCD panel display 10. A backlight inverter 20 is provided to drive one or more cold cathode fluorescent lamps (CCFLs) 22 and/or 24, includes a transformer 26 and controller 28, as is well understood in the art. A conventional computer system provides a LCD panel brightness level according to the command signal from the user, such as from the keyboard input or a potentiometer in the computer. The brightness of the LCD panel is fixed once the manual setup is set. The amount of power delivered to the backlight system is therefore fixed regardless the ambient brightness variations. Traditionally, users do not take the advantage of reducing the power level when the ambient light is reduced. To achieve a better utilization of battery power for appropriate LCD panel brightness while ambient light is changing, it is essential to implement auto-brightness control means to extend the battery run time for portable electronics. A light sensor 30 is provided to generate a signal indicative of the ambient light around the panel 10. The signal is fed to the backlight inverter 20 to adjust the amount of power delivered to the CCFL(s).

In a computer, the system may also include a system CPU 40 and line memory 50. The panel 10 may include a thin film transistor array (LCD) a scanner to synchronize operation of the LCD and a video data input module 16 and 18 to receive video data from line memory 50. These components are well understood in the art.

FIG. 2 depicts a conventional control system 200. In the conventional system, the panel brightness is controlled by comparing the current flowing through the CCFLs with the signal from the ambient light sensor output. The feedback signal in this control system is the sensed current flowing through the CCFL(s). This implementation represents an open-loop control with respect to the ambient brightness and the LCD brightness. One challenge is the LCD panel brightness varies even with the same amount of current flowing through the CCFL(s). Panel brightness can also vary on the manufacturing of the LCD panel including the material, thin-film-transistor technology, mechanical arrangement and the structure of the backlight module. This implementation is impractical and does not satisfy general requirement. As is known in the art, the display brightness lowers by more than half of the default brightness under cold temperature conditions with the same amount of current flowing through the CCFL(s). For example, the brightness of a LCD panel under room ambient condition of 350 lum/m^2; reduces to 120 lum/m^2 under −30 degree C. ambient condition. As a result, the brightness output from a display does not satisfy the users' requirement even under the same ambient light condition. Another example is the LCD display in a navigation system (global position system) in a car. Under low-temperature ambient, such ambient-sensor control system implementation for LCD in a car, does not produce sufficient light as needed or even fail to produce light output. Thus, this control system cannot sufficiently provide closed-loop feedback information to more accurately control the brightness of the panel. A target panel brightness signal is the desired output which should be used as a control signal for the controller and the power supply. Such open-loop control relies greatly upon the efficacy between the amount of power to the CCFL(s) and the LCD brightness output. Therefore, there is a need for a control system where the LCD brightness responds panel brightness. Further, the perception of the comfort level of the brightness varies from one user to another. Therefore, it there is also a need to have a user-command input to the control system to set a desired default display brightness level to satisfy the users a comfort level of brightness.

BRIEF DESCRIPTION OF THE DRAWINGS

It will be appreciated by those skilled in the art that although the following Detailed Description will proceed with reference being made to preferred embodiments and methods of use, the present invention is not intended to be limited to these preferred embodiments and methods of use. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein.

DETAILED DESCRIPTION

Figure 3:
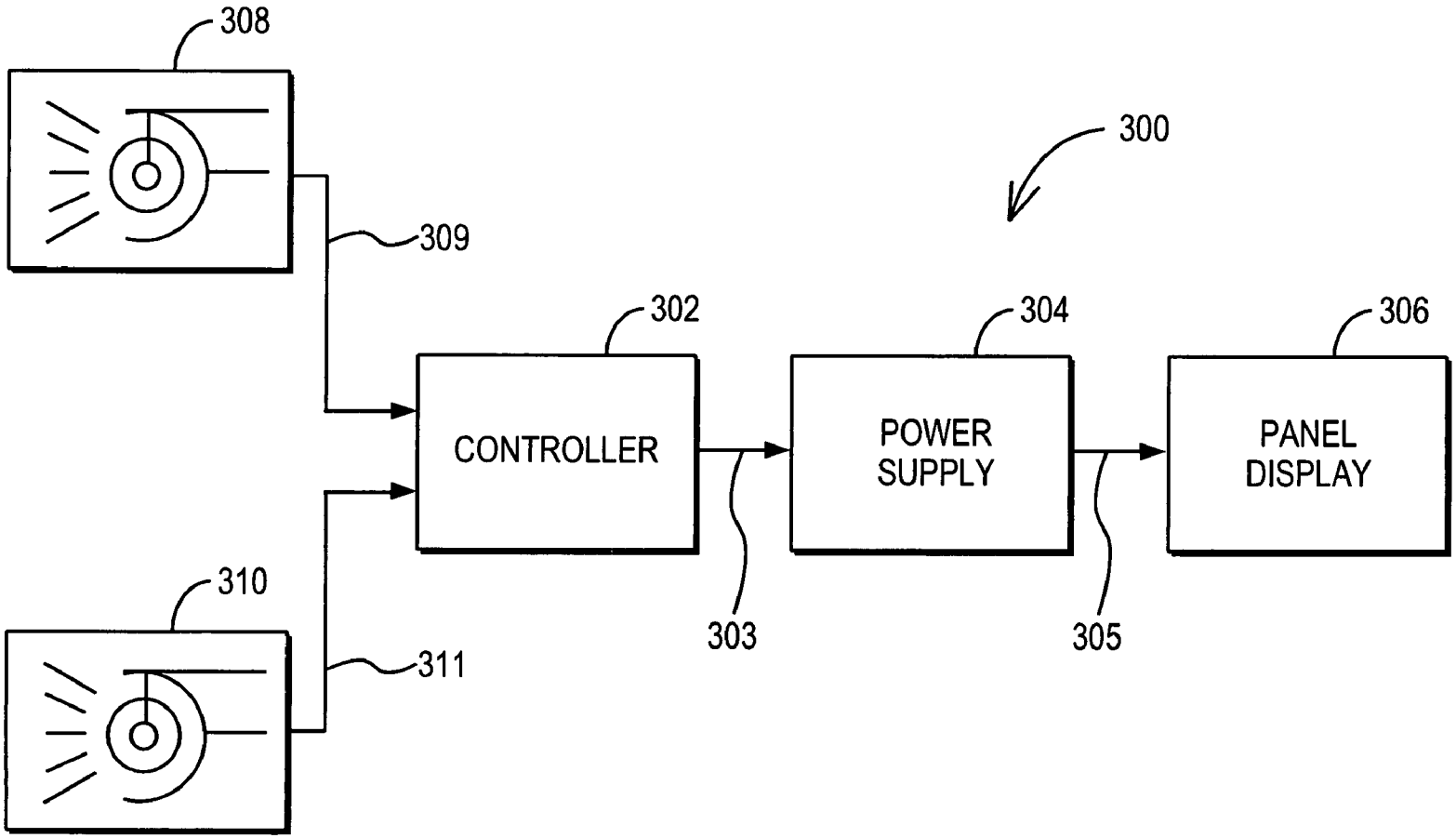
FIG. 3 illustrates a system embodiment of an exemplary brightness control system.

FIG. 3 depicts illustrates a system embodiment of an exemplary brightness control system 300. The system 300 may include a power supply control circuitry 302 (hereinafter "controller 302"), a power supply 304, a panel display 306, an ambient light sensor 308 and a panel brightness sensor 310. The power supply controller 302 may comprise a conventional and/or custom inverter control circuitry that may be capable of generating at least one power control signal 303. Power control signal 303 may be used by a power supply circuitry 304 as a target power output of the power supply 304. Thus, power control signal 303 may be used to control the operation of the power supply circuitry 304. The power supply circuitry 304 may comprise a conventional and/or custom DC/AC inverter circuitry. For example, well known DC/AC inverter circuitry may include full bridge, half bridge, push-pull, and/or Royer inverter topologies (and modifications thereto), any one of which may be employed in the present embodiment. Alternatively, after developed inverter circuits and/or custom inverter circuits shall be considered equivalents to the scope of the present embodiment. The power supply circuitry 304 may be capable of generating a controlled power supply signal 305 to a panel display 306. Panel display 306 may include one or more lamps, for example CCFLs, which may be capable of illuminating the panel display 306.

Circuitry, as used in any embodiment herein, may comprise, for example, singly or in any combination, hardware circuitry, programmable circuitry, state machine circuitry, and/or firmware that stores instructions executed by programmable circuitry.

Figure 1:
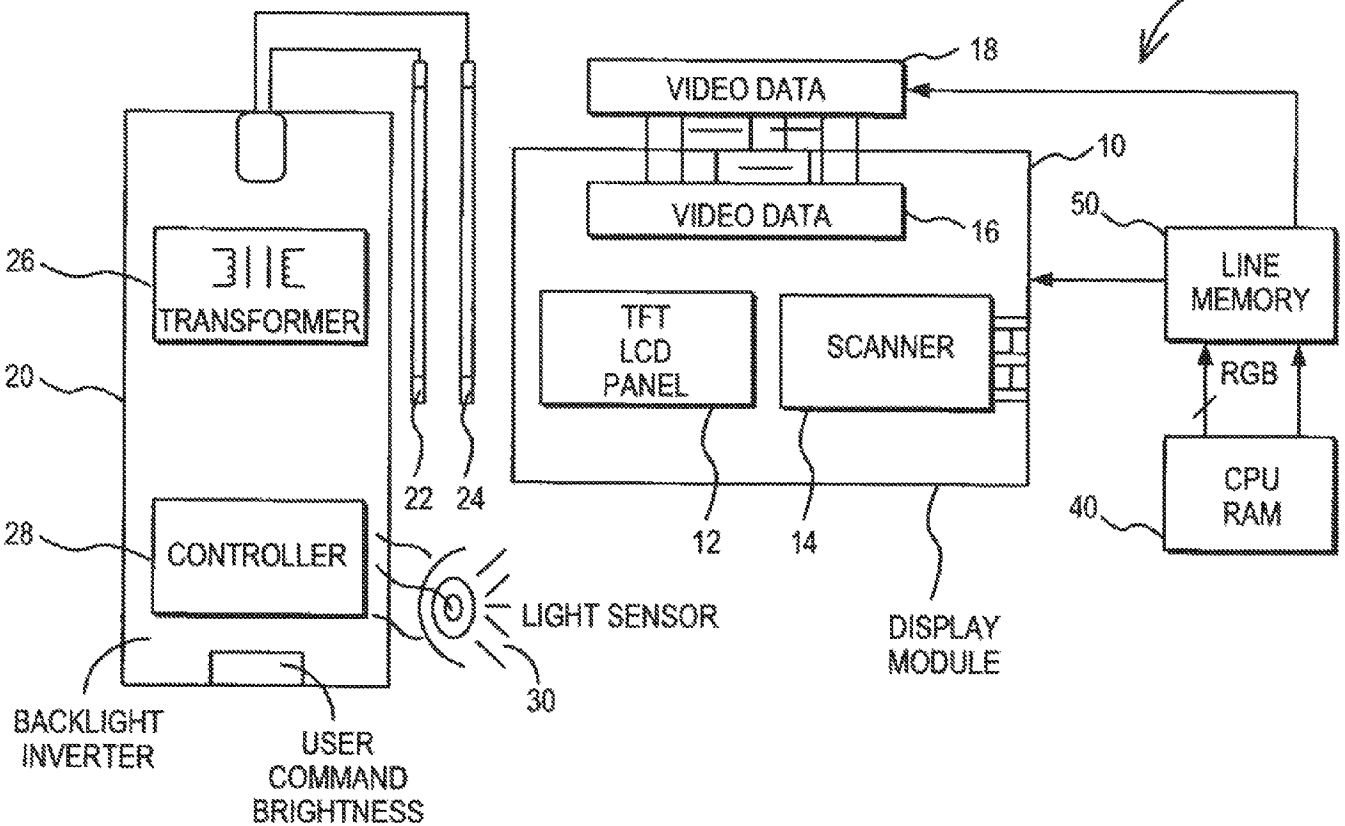
FIG. 1 PRIOR ART
FIG. 1 illustrates a conventional computer system.
Figure 2:
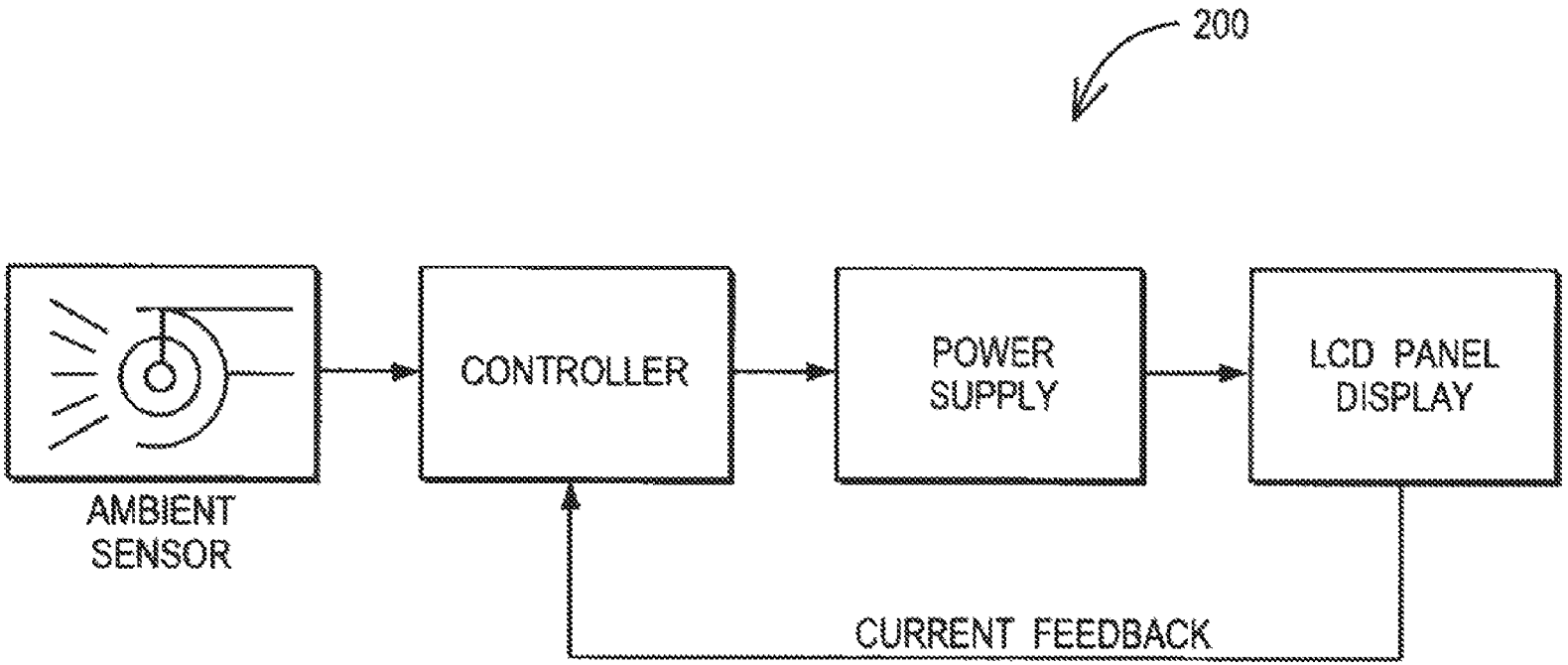
FIG. 2 PRIOR ART
FIG. 2 illustrates a conventional brightness control system.

For example, an inverter controller 302 may comprise the OZ960, OZ961, OZ969A, OZ970, OZ9RRA, OZ971 OZ972 and/or OZ976 manufactured by O2Micro International Limited. Of course, alternatively, other inverter controller circuitry as may be provided by other manufacturers may be used in any embodiment herein. In this embodiment, an ambient light sensor 308 may be provided that is capable of generating an ambient light signal 309 indicative of the ambient light conditions around (i.e., in the vicinity of) the panel display 306. Further, a panel brightness sensor 310 may be provided that is capable of generating a panel brightness signal 311 indicative of the brightness (e.g., illumination output) of the panel display 306. Controller 302 may be capable of receiving at least one of command signal and feedback signal information from a plurality of sources. For example, signal 311 may provide feedback information to controller 302, and signal 309 may provide a command to the controller 302. In turn, controller 302 may include circuitry, for example a comparator (not shown), to compare signals 309 and 311, and adjust the control signal 303 based on such feedback information. Of course, controller 302 may also be capable of receiving a voltage and/or current feedback signal from the panel display 306 (such as depicted in FIG. 2), and may further be capable of adjusting the control signal 303 based on such feedback information.

Sensors 308 and 310 may comprise any light sensors known in the art, and may be selected, for example, based on light sensitivity or tolerance parameters which may be desirable for a given application. It is intended throughout this disclosure (unless specified to the contrary herein) that the ambient light and panel brightness sensors shall include generic (i.e., off-the-shelf), custom, or proprietary sensors which may be used in a manner described herein. Thus, the term sensor shall be construed broadly to cover any and all currently available and after-developed light sensor mechanisms and circuitry known in the art, and further, all such sensors are deemed equivalents herein.

In an exemplary embodiment, for example, the controller 302 compares signals 309 and 311. The controller 302 may comprise circuitry to generate a power supply control signal 303 to control the operation, and the power output of, power supply 304 based on, at least in part, signals 309 and 311. In turn, the brightness of one or more lamps associated with the panel display can be adjusted based on, at least one of ambient feedback information (signal 309), panel brightness feedback information (signal 311) and/or voltage and current feedback information from the CCFL lamp (or lamps in a multiple lamp embodiment).

Figure 3A:
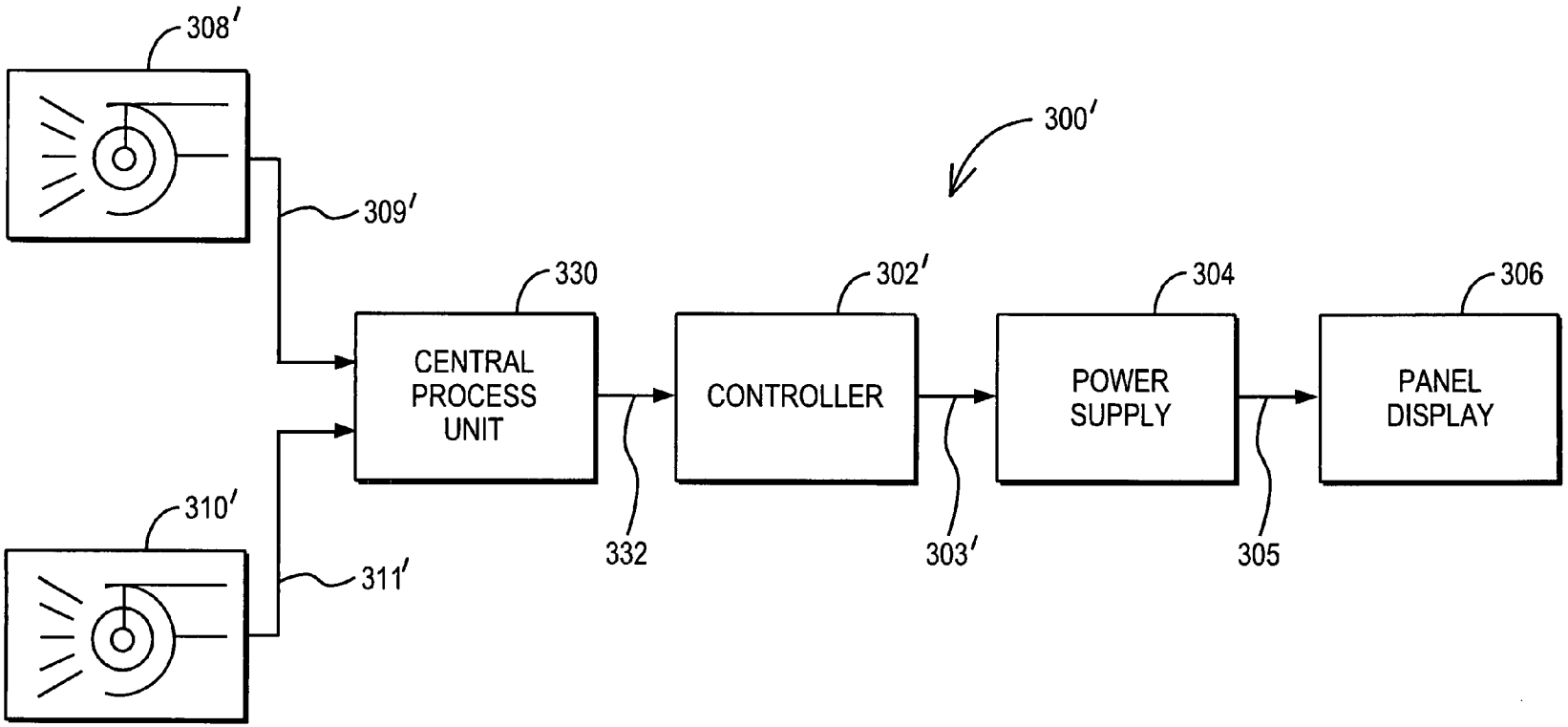
FIG. 3*a* illustrates another system embodiment of an exemplary brightness control system.

FIG. 3*a* shows another exemplary brightness control system 300'. In this example, a processor 330 may receive signals from the ambient light sensor 308' and the panel brightness sensor 310'. The processor 330 may be used to process signals 309' and 311' to send a signal 322 to controller 302'. For example, processor 330 may comprise A/D circuitry to convert the analog signals 309' and/or 311' to digital signals, and execute digital signal processing before sending output 332 to the controller 302'. Of course, the output 332 can be digital or analog, depending on the requirements of controller 302'. In turn, the controller 302' generates a power control signal 303', in a manner described above with reference to FIG. 3.

Figure 4:
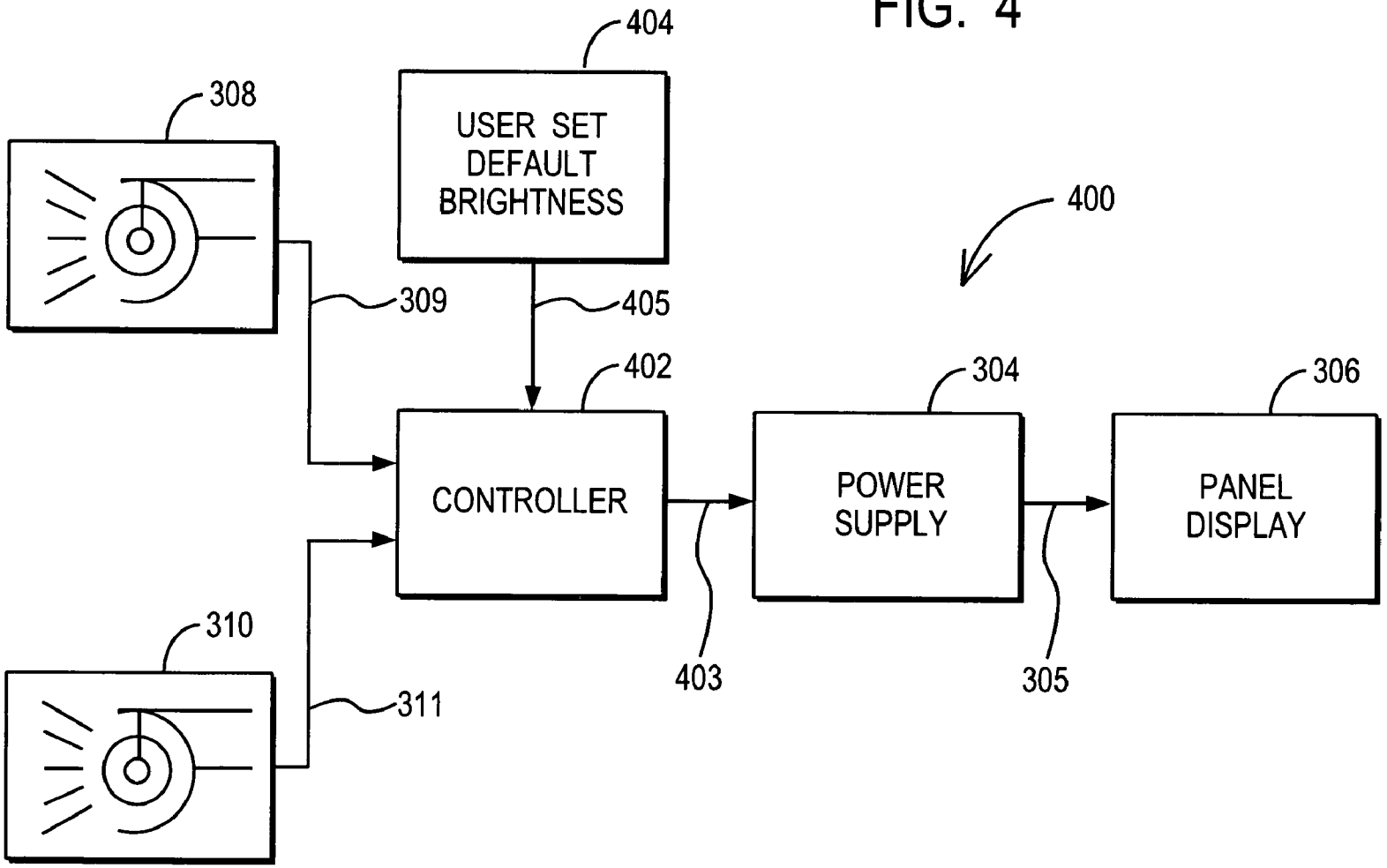
FIG. 4 illustrates another system embodiment of an exemplary brightness control system.

FIG. 4 illustrates another exemplary system embodiment 400. This exemplary embodiment is similar to the embodiment of FIG. 3, and may further include default brightness set circuitry 404. In an exemplary embodiment, default brightness set circuitry 404 may be capable of generating a user definable and/or programmable default signal 405, which may be indicative of a users' desired panel brightness level (e.g., a default panel brightness level). In this embodiment, signal 405 may operate as a command signal that sets a threshold level for the controller. Thus, for example, the default signal 405 may be used by the controller 402 to set a desired brightness value which, in turn, may cause controller 402 to add a weighting factor to the signals of 309 and 311, or provide a threshold to limit a range of brightness variations, thus permitting a user to operate the panel display at a desired brightness level. Alternatively, and without departing from this embodiment, signal 405 may operate as a "ceiling" or "floor" value. In this instance, controller 405 may add an operation to compare signal 405 with signal 311 to ensure that the panel brightness does not exceed or fall below the brightness level indicated by signal 405, in addition to the comparison of signals 309 and 311 described above.

Default circuitry 404 may comprise user input circuitry. User input circuitry may comprise, for example, a variable resistor (e.g., user controlled potentiometer) located on the panel display 306 or on the vicinity of a keyboard area. Alternatively, user input circuitry may comprise a specified computer operation, which may include a selected keystroke operation on a keyboard associated with a computer system. Such an implementation may include, for example, software and/or firmware instructions, executed by the computer system to control a keyboard in an appropriate manner to generate the default control signal 405, as will be understood by those skilled in the art. Further alternatively, default circuitry 404 may be capable of receiving instructions from a software interface associated with a computer (in which case, for example, default circuitry 404 may comprise bus interface circuitry to receive commands and/or data from a computer bus (not shown), as is understood in the art). Alternatively, default circuitry 404 may comprise a preprogrammed and/or user programmable circuit that is capable of generating a preprogrammed (or user programmable) control signal 405.

As stated previously, system 400 operates in a similar manner as system 300 of FIG. 3. Controller 402 may be capable of generating a power supply control signal 403 as a function of any one of signal 309, signal 311 and/or signal 405. In turn, power supply 304 may generate a power signal 305 to supply power to the panel display 306.

Figure 14A:
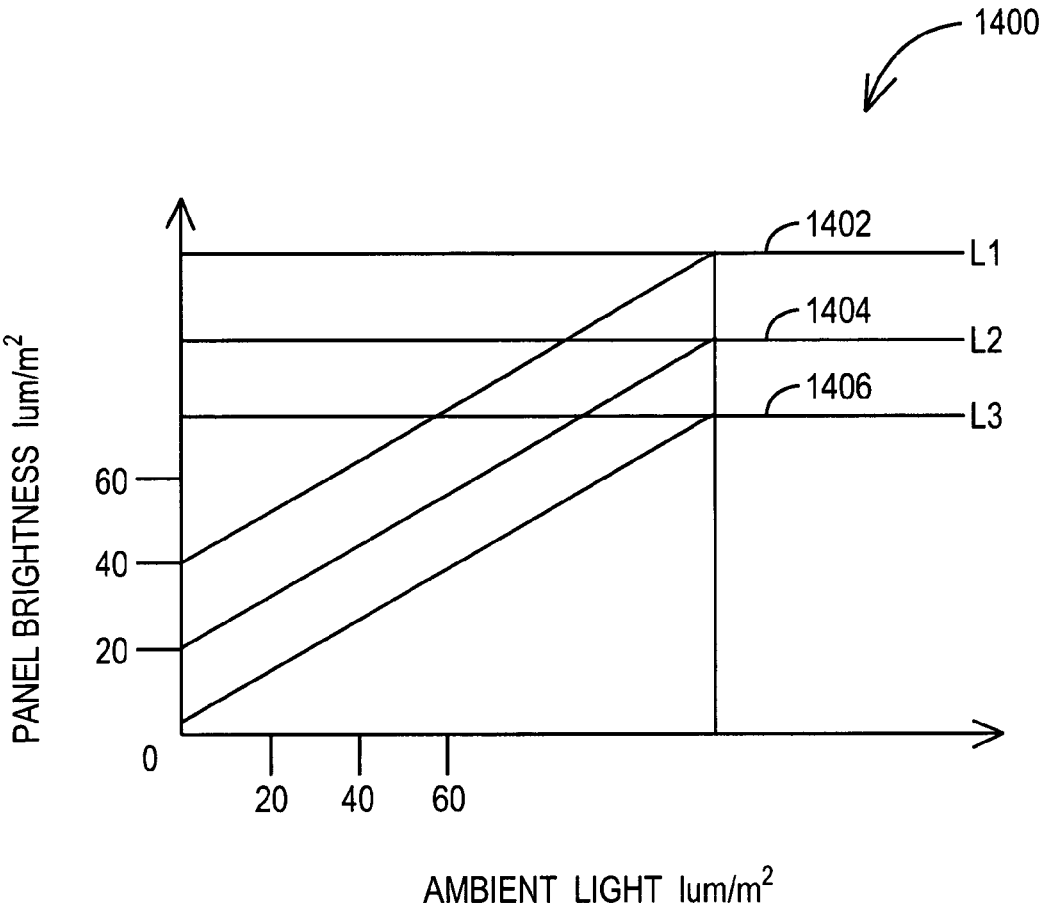
FIGS. 14A, 14B and 14C illustrate exemplary panel-ambient brightness graphs.
Figure 14B:
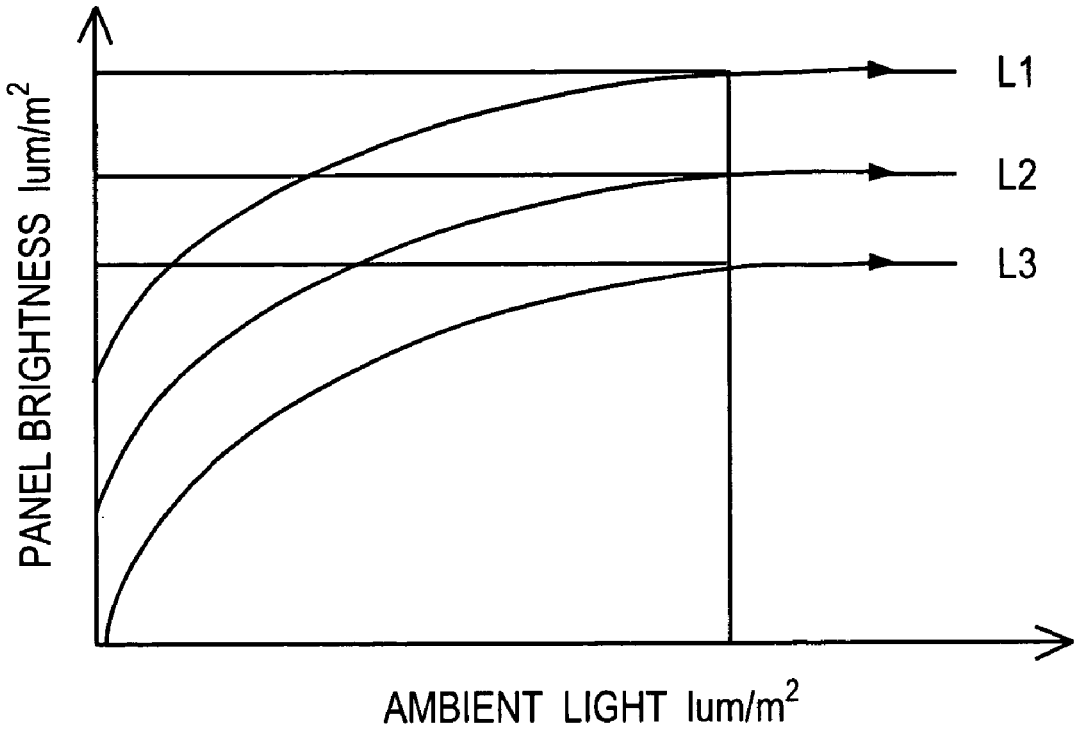
Figure 14C:
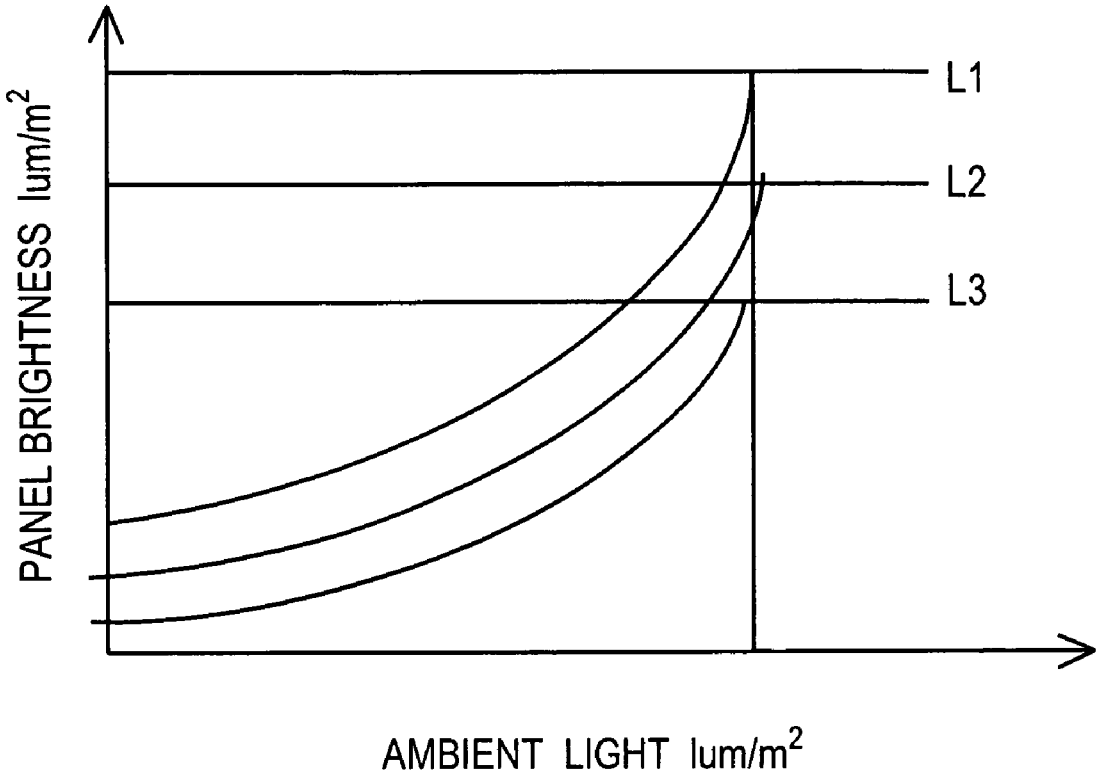

It will be understood by those skilled in the art that signal 309 and 311 generated by sensors 308 and 310, respectively, may comprise analog signals indicative of the sensed light. Of course, if controller 302 or 402 is adapted to receive digital signals, analog to digital circuitry (not shown) may be provided to convert signals 309 and 311 into digital signals. Alternatively, one or more of the sensors described herein may comprise appropriate A/D circuitry which may generate a digital signal indicative of the sensed light level. FIG. 14A illustrates an exemplary graph 1400 of ambient light and panel brightness relationships. In this example, controller 402 may use a command signal (for example, an ambient light signal) to determine an appropriate panel brightness. The controller may relate panel brightness as a function of ambient light in a linear fashion, as depicted. One or more user levels L1, L2 and/or L3 may be used to limit the brightness of the display, as depicted. In this example, user levels L1, L2 and/or L3 may be generated by user default brightness circuitry 404 as depicted in FIG. 4. As shown in FIG. 14A, user levels L1, L2 and/or L3 may operate as a maximum threshold signal (signals 1402, 1404 and/or 1406, respectively), i.e., where the panel brightness is limited after a certain defined ambient light value. FIGS. 14B and 14C depict nonlinear relationships between ambient light and panel brightness, and may include, for example, logarithmic, exponential, quadratic, and/or other nonlinear relationships. Of course, other control relationships may exist without departing from any embodiment herein.

Figure 4A:
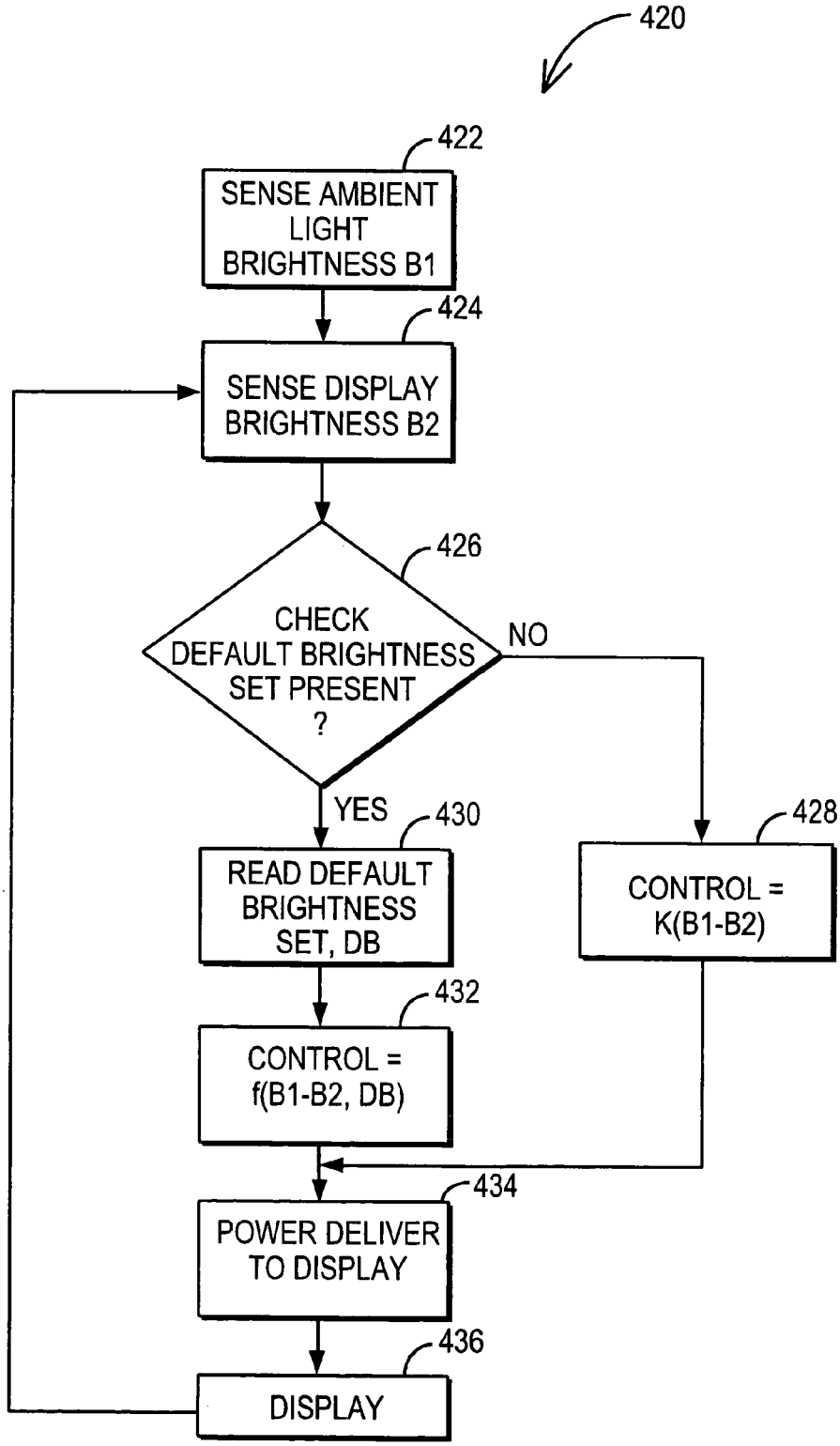
FIG. 4A depicts a flowchart illustrating exemplary operations according to an embodiment.

FIG. 4A depicts a flowchart 420 of operations which may be performed according to an embodiment. The flowchart 420 generally depicts operation which may be performed by the controller (302, 302' and/or 402) to controllably deliver power to the display. Operations may include sensing ambient light brightness (signal B1) 422 and panel display brightness (signal B2) 424. The controller may also determine if a default panel brightness signal is present 426. If not, then the controller may be capable of controlling the power delivered to the panel display (434) based on, at least in part, signals B1 and B2 428. If a default panel brightness signal is present, the controller may be capable of reading this signal and setting the value (DB) 430. The controller may be capable of controlling the power delivered to the panel display (434) based on, at least in part, signals B1, B2 and DB 432. The display is then powered 434 using one of the control operations described above, to illuminate the display 436.

Figure 5:
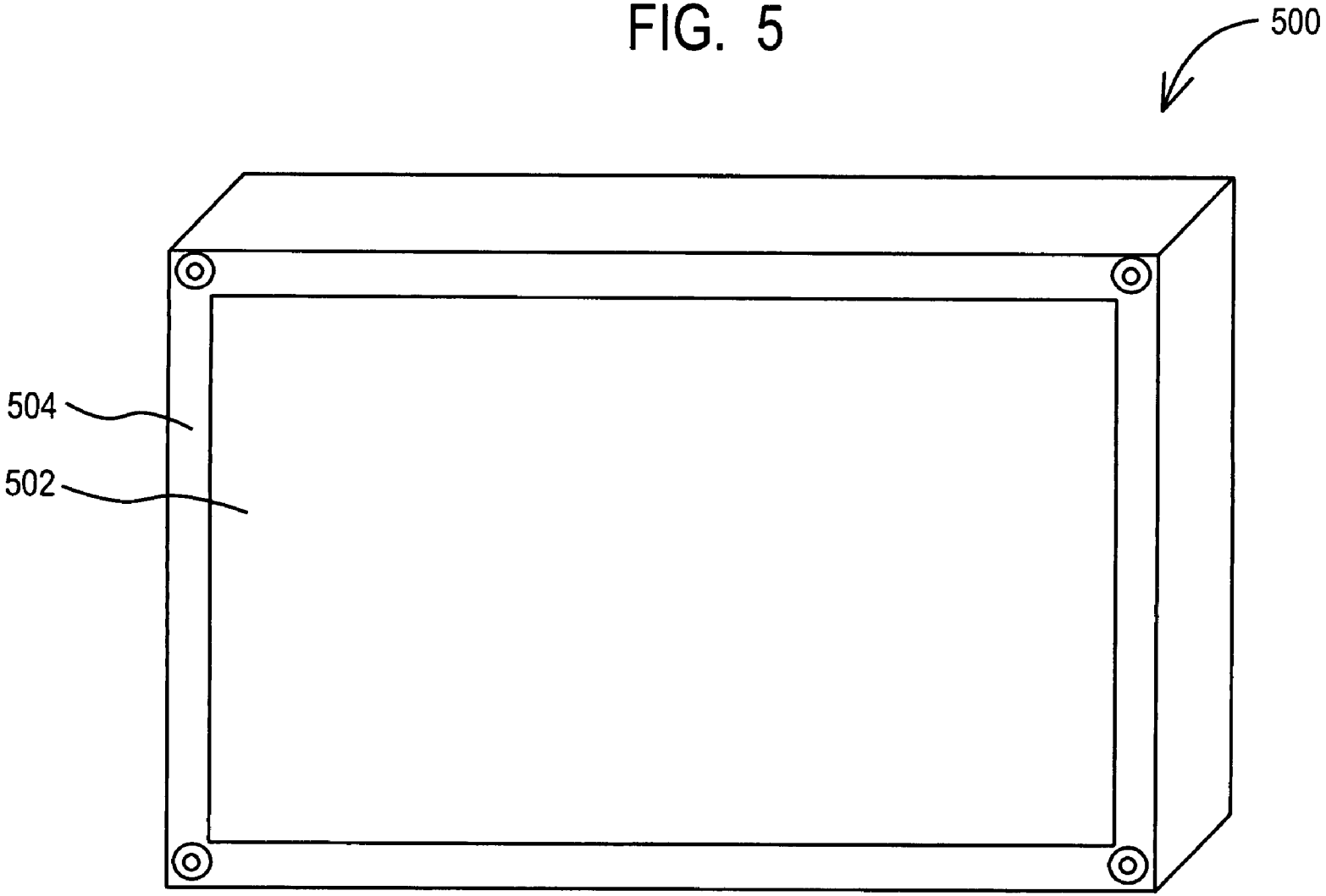
FIG. 5 illustrates a front view of a conventional LCD panel.

FIG. 5 depicts a conventional LCD panel display 500. A conventional LCD display 500 generally includes an LCD glass front panel 502 and a bezel housing 504 generally around the periphery of the front panel 502.

Figures 6, 6A:
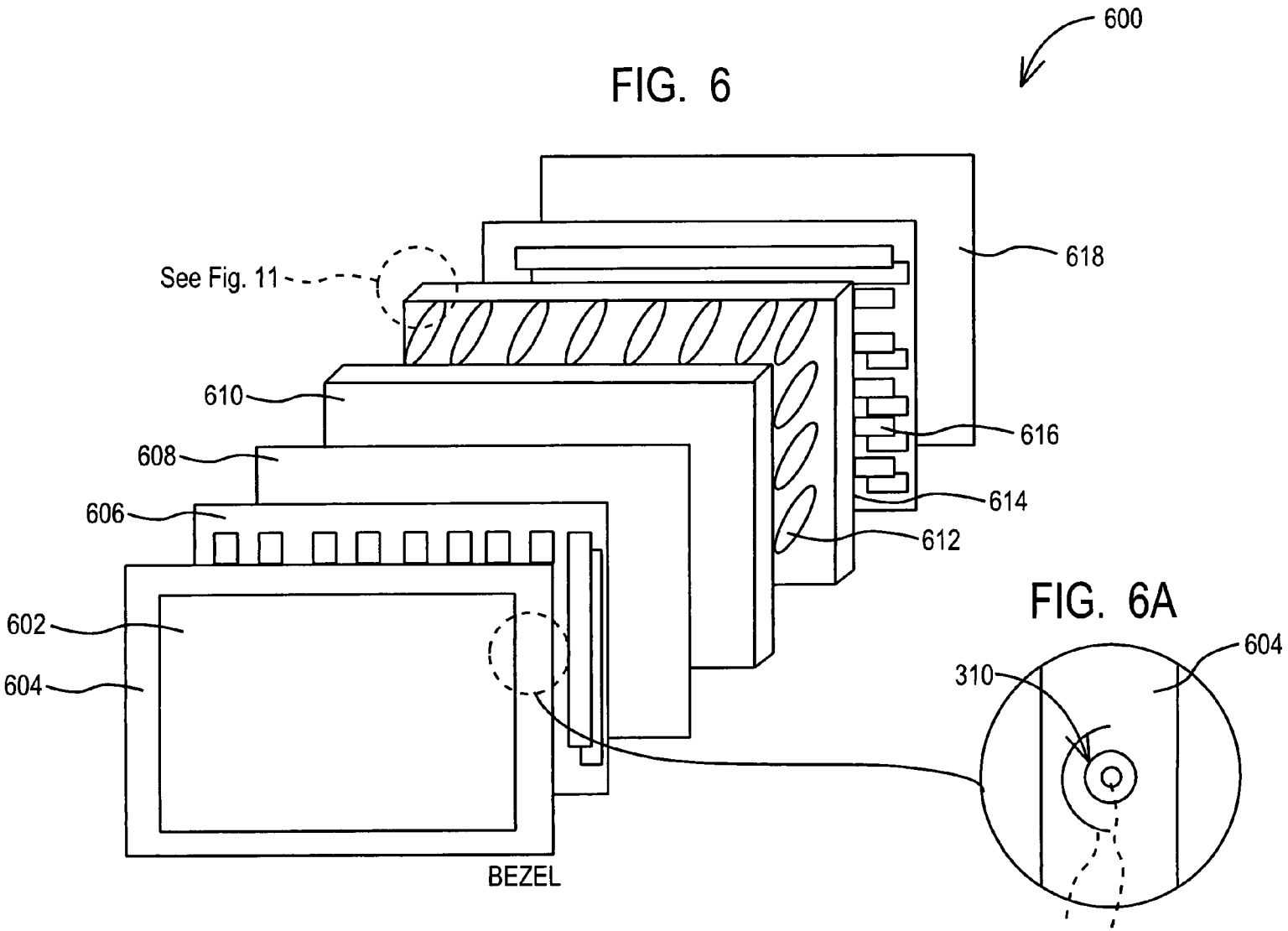
FIG. 6 illustrates the structure of an exemplary LCD panel, and further illustrates a sensor associated with the panel.

FIG. 6 depicts an exploded view of an exemplary LCD panel 600 according to one embodiment. Conventional components of an LCD panel may include a front glass 602, a bezel 604 generally surrounding at least the front glass, a first polarizer 606, a color filter 608, a glass layer 610, liquid crystal molecular 612, a thin film transistor (TFT) glass 614, a second polarizer 616 and a backlight reflector 618. Many variations are known in the LCD panel arts, and it is to be understood that components 602-618 may be modified in a variety of fashions known in the art, and all such modifications are deemed equivalent to the scope of this embodiment. In an exemplary embodiment, inside the bezel 604 a panel brightness sensor may be included. As depicted in FIG. 6A, a panel brightness sensor 310 may be disposed within the bezel along the periphery of the bezel, thus permitting the sensor 310 to receive light from the panel.

Figure 7:
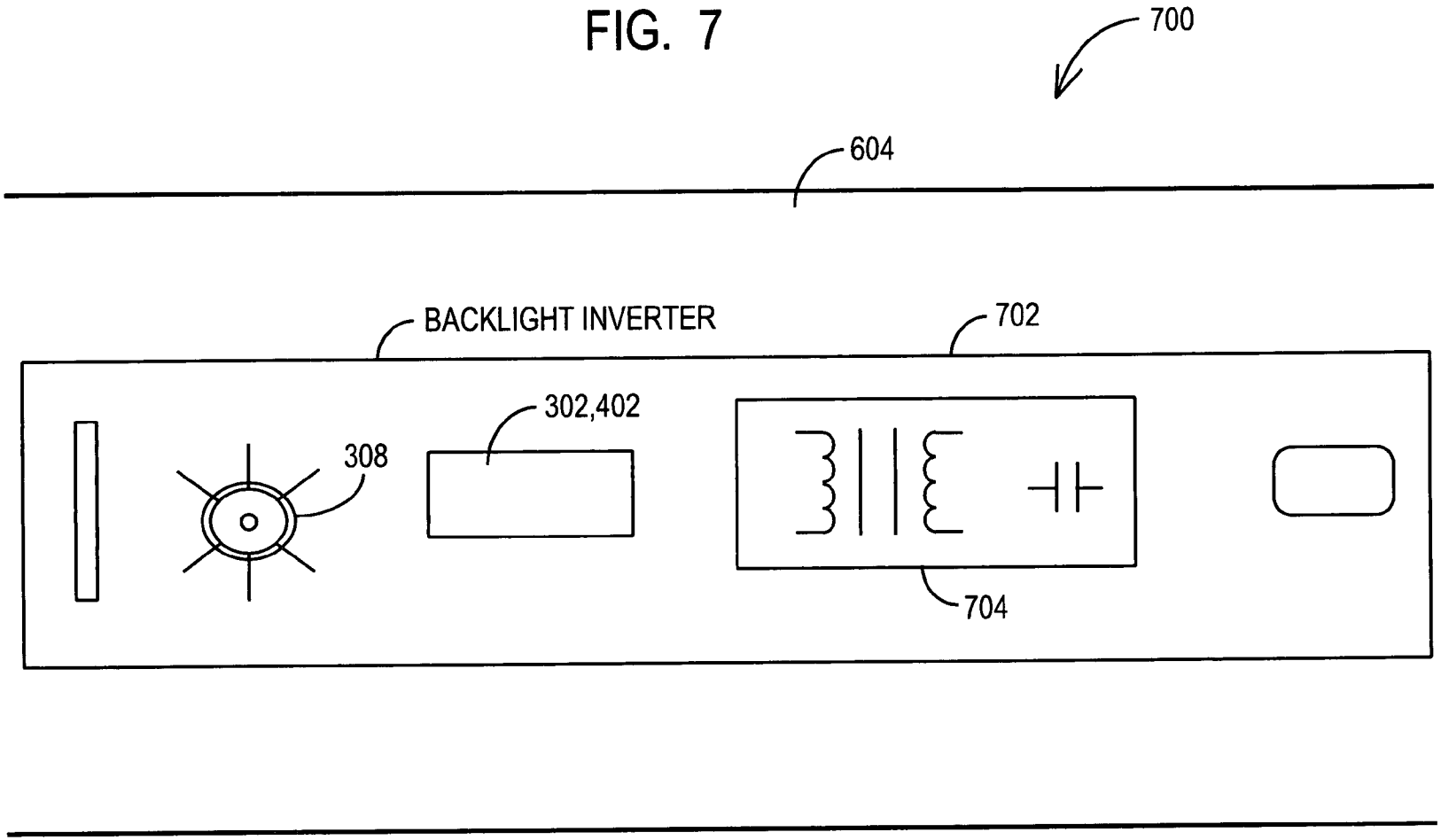
FIGS. 7-10 illustrate exemplary module embodiments.
Figure 8:
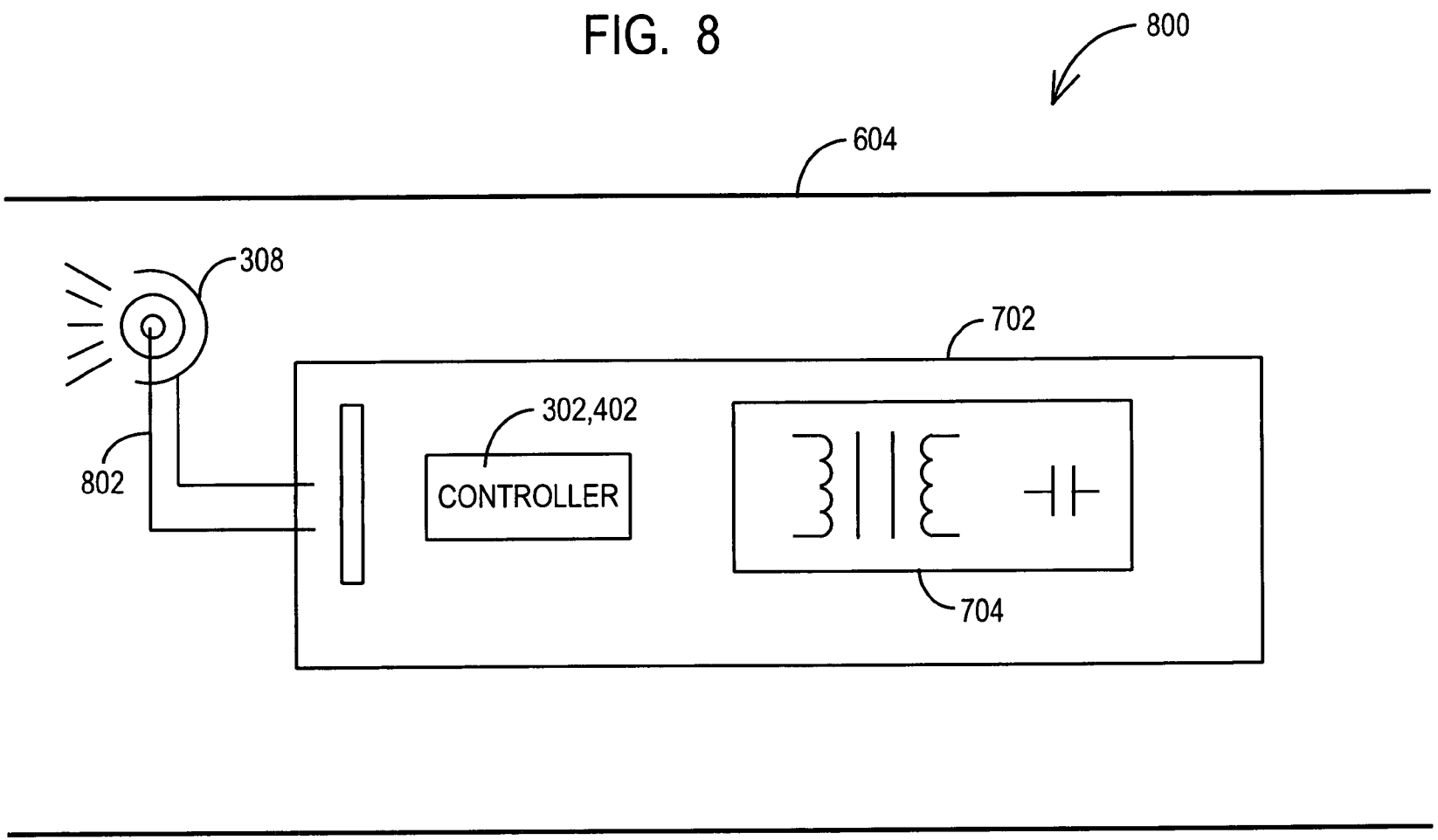
Figure 9:
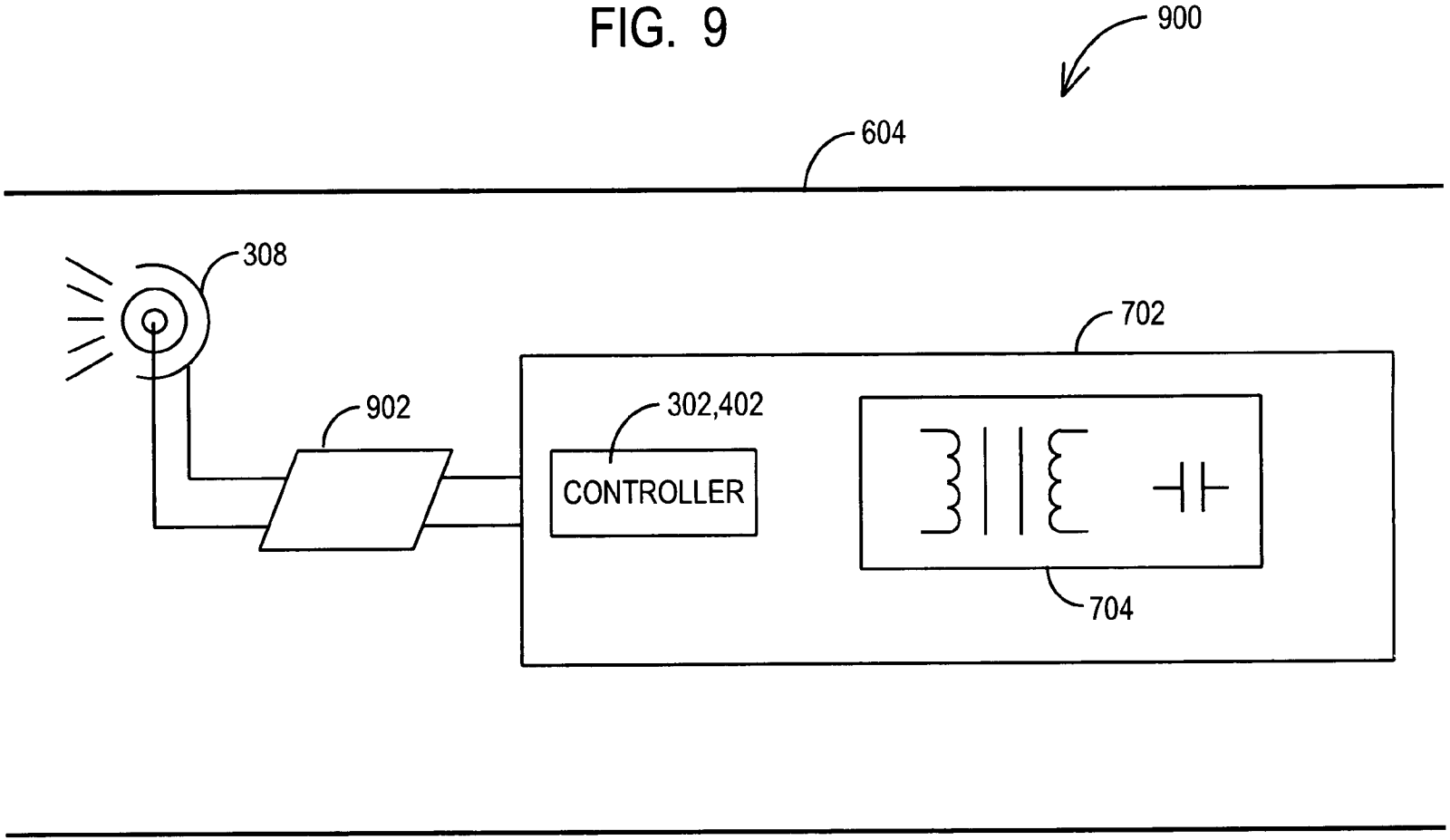

FIG. 7 illustrates an exemplary power supply module 700. An exemplary module 700 may include some or all of the circuit components described above implemented on a printed circuit board (PCB) 702 and a bezel 604. For example, in one embodiment, the PCB 702 is dimensioned to fit within the bezel 604 of an LCD panel, and may generally include DC/AC inverter circuitry. Generally, the module may include circuitry to generate an AC signal, (to power one or more CCFLs as is well understood in the art), and may include a controller (for example, controller 302 or 402) and a power circuit 704 that may includes magnetic and/or capacitive elements. In this embodiment, an ambient sensor 308 may also be coupled to the PCB. The PCB 702 may be disposed within the bezel 604 so that sensor 308 is aligned, at least in part, with an opening in the bezel (not shown) so that ambient light can reach the sensor 308. Another exemplary module 800 is depicted in FIG. 8. In this embodiment, the sensor 308 may be remote from the PCB 702 disposed inside the bezel 604. Communication link 802 may be provided to provide signals from the sensor 308 to the PCB 702 (and to controller 302 or 402). Still another exemplary module 900 is depicted in FIG. 9. In this embodiment, sensor 308 may be mounted on a PCB of a panel where the timing controller and row/column drivers may be mounted and may further be electrically coupled to PCB 702 disposed inside the bezel 604 via a flexible cable member 902.

Figures 10, 10A:
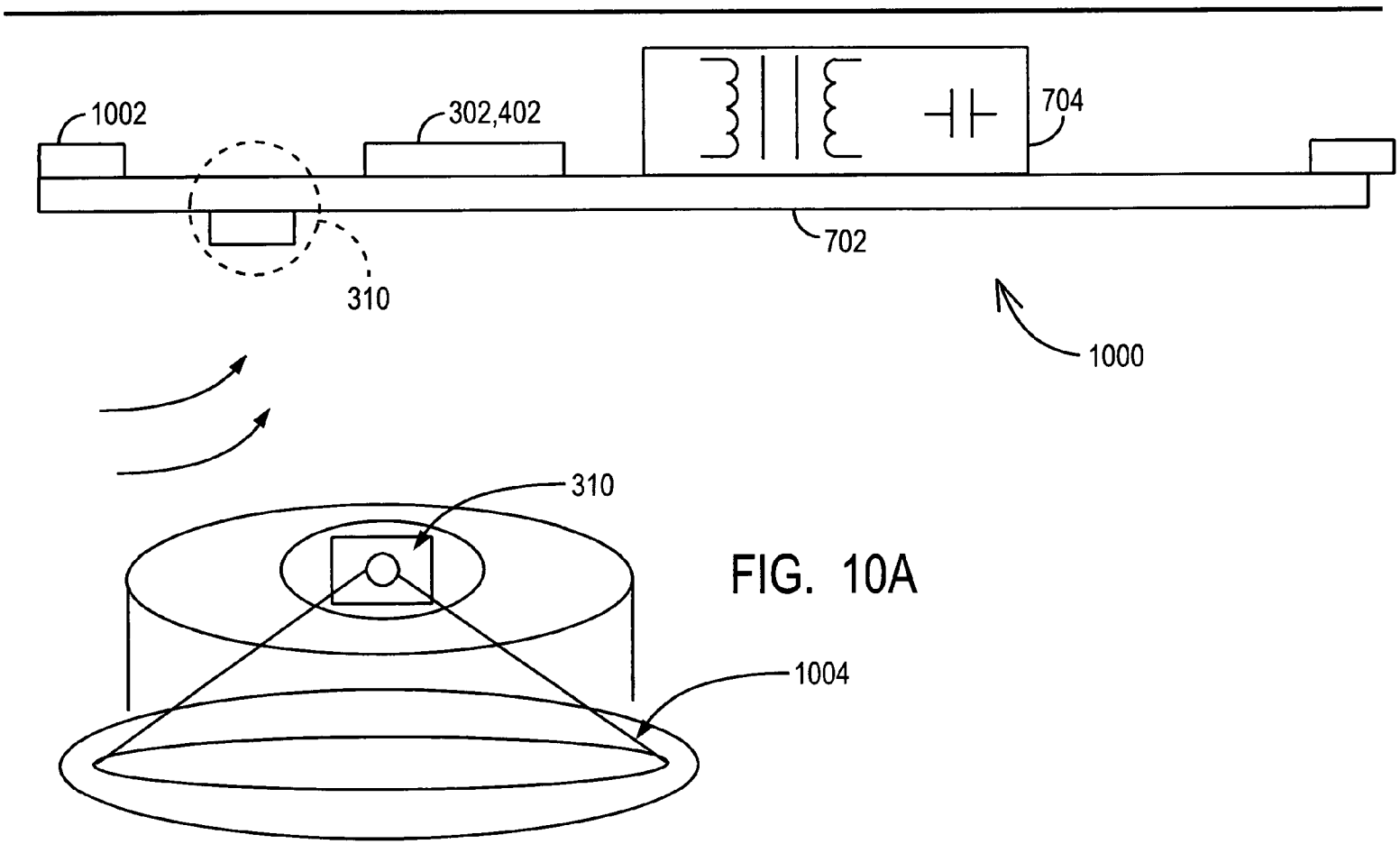

FIG. 10 depicts yet another module embodiment 1000 and may include a panel light sensor 310 coupled to the PCB 702 which may be disposed inside a bezel 604. In this example, the sensor 310 may be coupled to the underside of the PCB, as shown. In this manner panel light may be received directly from the front glass of the panel. As shown in FIG. 10A, the sensor 310 may be disposed on the PCB in a manner that creates an appropriate sensing angle 1004 to receive a desired quantity of photons from the panel. The PCB may include one or more connectors 1002 which may be coupled to an ambient light sensor (not shown), such as any ambient light sensor depicted in the Figures.

Figures 11, 11A:
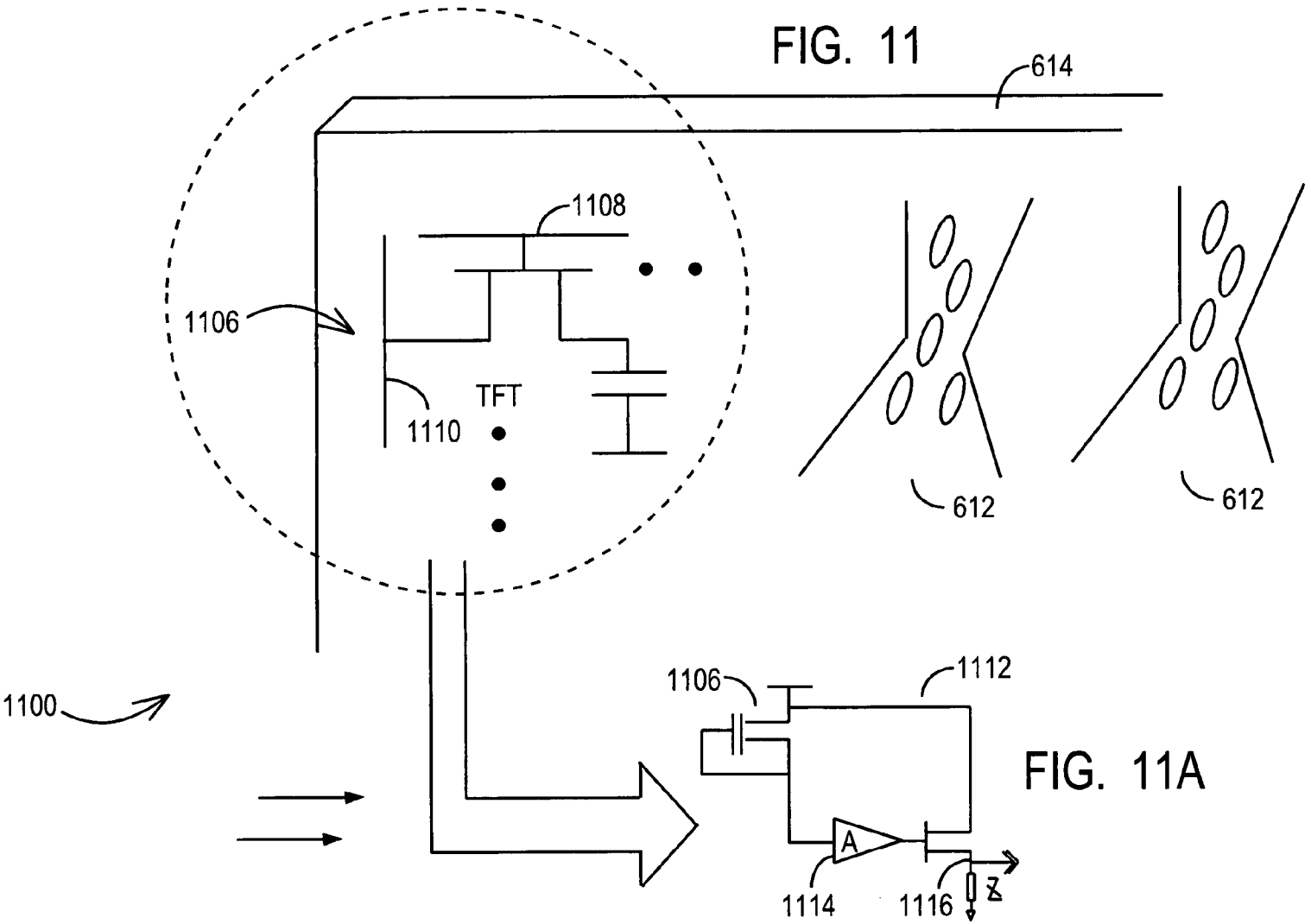
FIGS. 11-13 illustrate exemplary sensor circuitry.

FIG. 11 depicts an exemplary panel light sensor 1100. With reference to the liquid crystal molecular 612 depicted FIG. 6 and TFT glass 614, a plurality of TFTs 1106 may be provided. Each TFT typically represents a color pixel, and the glass 614 generally includes an array of TFTs to make up the display. In this embodiment, TFTs 1106 may be modified to operate as a light sensor. Any of the TFTs may be modified, and in an exemplary embodiment a plurality of TFTs hidden by the bezel (not shown) may be selected. FIG. 11A depicts an exemplary panel light sensor 1112, which may be formed by modifying a plurality of TFTs. In this embodiment, an amplifier 1114 may be provided to amplify a signal associated with current flowing the TFTs. The amplified signal 1116 may be indicative of the panel brightness, and may be used, for example by controller 302, 402 as a panel brightness signal. Of course, a plurality of TFTs may be modified in this manner such a modification and may further include circuitry to average the output of the plurality of modified TFTs and thus generate an average panel brightness signal.

Figure 12:
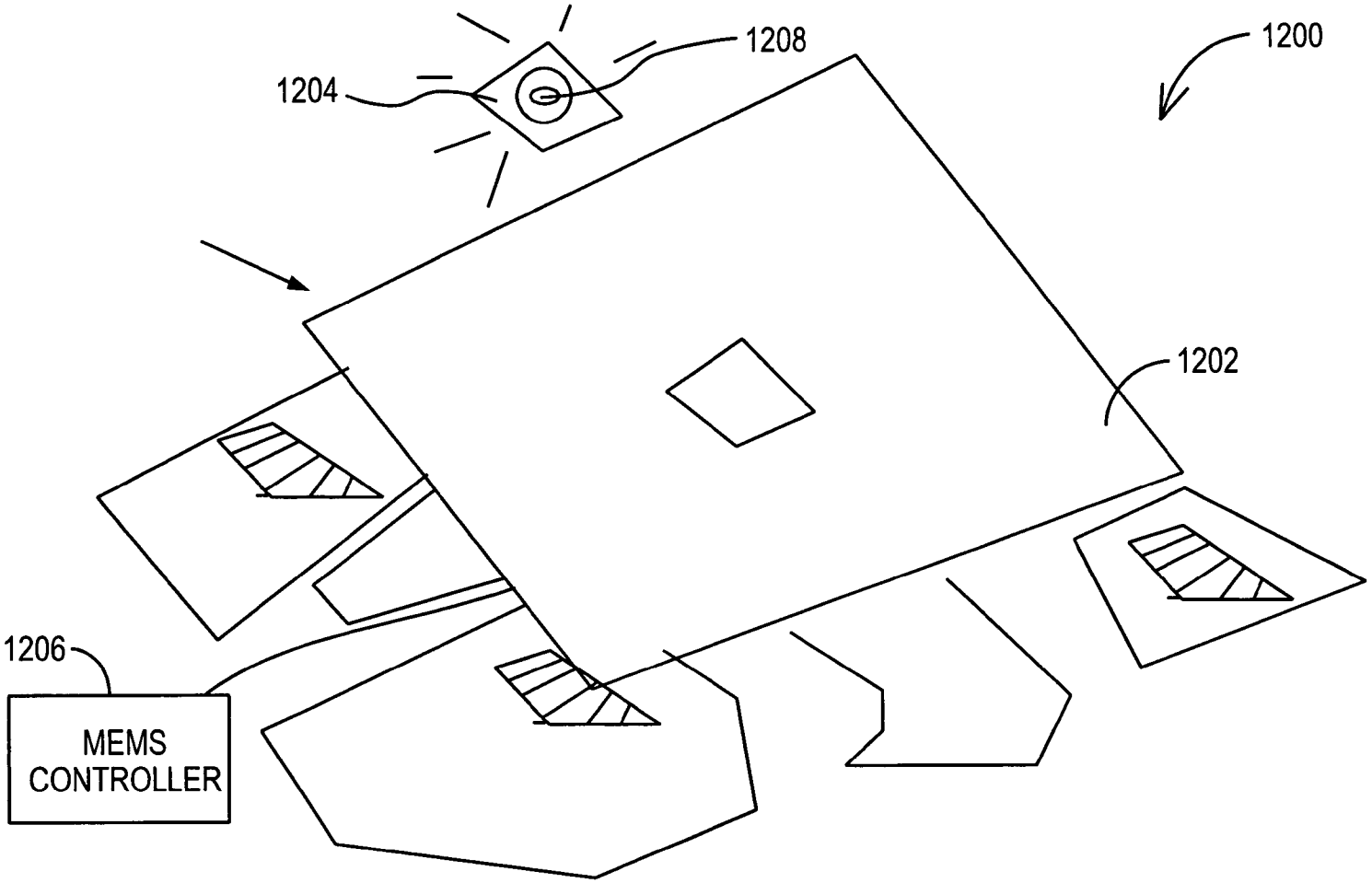

FIG. 12 depicts an exemplary light sensing system 1200. In this embodiment, the system may comprise a MEMS (micro-electro-mechanical system) mirror 1202, MEMS controller 1206 and light sensor 1204. The MEMS may include a mirror panel 1202 which may operate to reflect light into a sensor 1204. The sensor 1204 may be used as the ambient light sensor (such as sensor 308) or the panel brightness sensor (such as sensor 310), or two such sensors may be provided to sense both ambient and panel light.

Alternatively, in this embodiment, the MEMS mirror 1202 may be operable to provide both ambient light sensing and panel brightness sensing. As is understood in the art, MEMS can be formed so that the mirror 1202 can flex in a controllable manner. Thus, mirror 1202 can be adapted to controllably flex to reflect light toward light sensor 1204. Additionally, another sensor may be provided (not shown) and mirror 1202 can be adapted to reflect light toward that sensor. Thus, the mirror can be used to reflect both ambient light and panel brightness light toward one or more sensors (such as sensor 1204). Sensor 1204 may include one or more signal lines 1208 to transmit the sensed light signal value (as an input, for example, to a controller) A MEMS controller 1206 may be provided to controllably flex the MEMS mirror 1202 to provide a desired input of both ambient light in a first time interval and panel brightness light in a second time interval.

Figure 13:
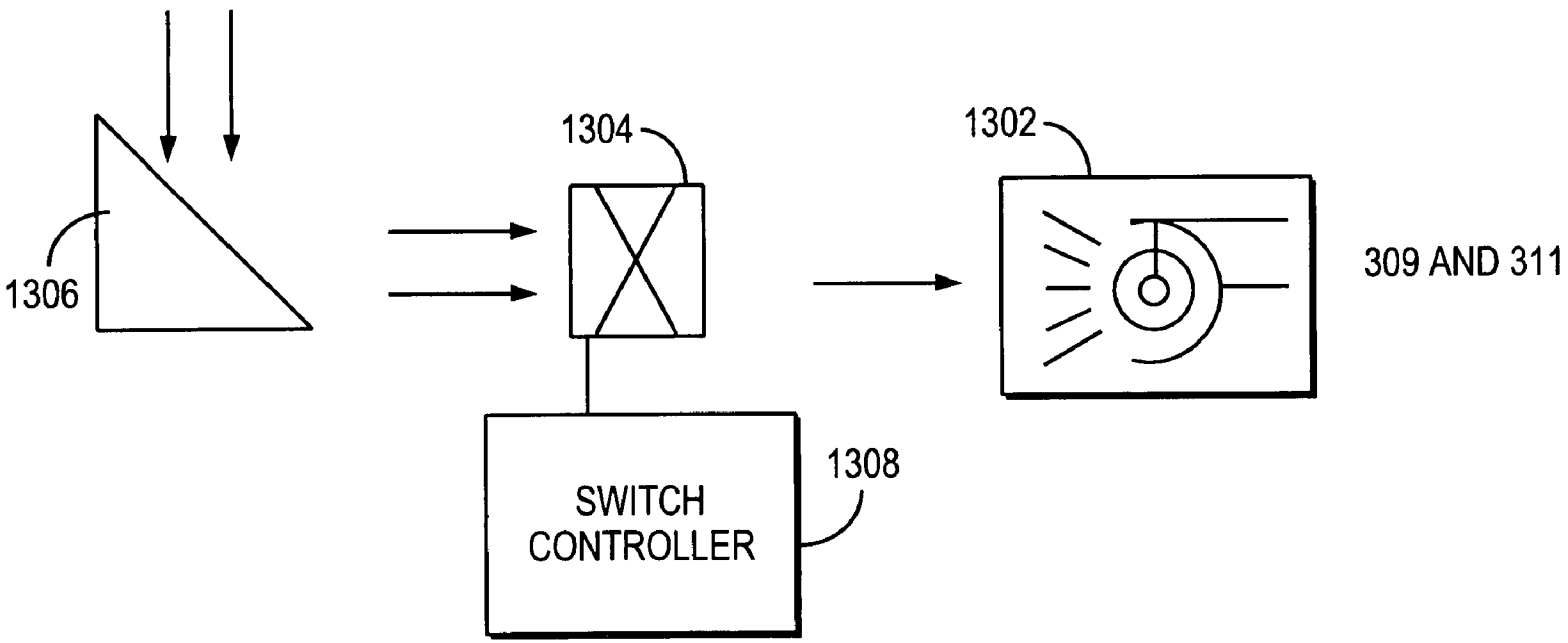

FIG. 13 depicts another sensor embodiment 1300. In this embodiment a light sensor 1302 (for example, sensor 308, 310 and/or 1204) may be adapted to receive panel light via an optical switch 1304. Depending on the physical placement of the sensor 1302 with respect to a panel, the present embodiment may also include a mirror (or equivalent) 1306 to fold or bend incoming light in an appropriate manner to be received by the sensor. In this exemplary embodiment, switch 1304 may be a controllable switch. Controllable switch 1304 may act as a gate for light transmission. In such an implementation, sensor 1302 may provide both ambient light sensing and panel brightness sensing, depending on the state of the switch 1304. A switch controller 1308 may be provided to control the conduction state of switch 1304. Thus, for example, switch controller may control the switch 1304 so that the sensor receives panel light in a first time interval and ambient light in a second time interval. Thus, sensor 1302 may operate as both a panel brightness sensor and an ambient light sensor.

In the embodiments of FIGS. 12 and 13 where the sensor operates as both a panel brightness sensor and an ambient light sensor, the switch controller or MEMS controller may be synchronized to an external synchronization signal. Additionally, the signal received by the controller (e.g., controller 302 and/or 402) will contain both panel brightness and ambient light information. Thus, the controller may also be synchronized to the control operations of the switch 1304 or MEMS 1202, thereby permitting, for example, the controller (302, 402) to receive ambient light and panel brightness information in a controllable manner.

Figure 15A:
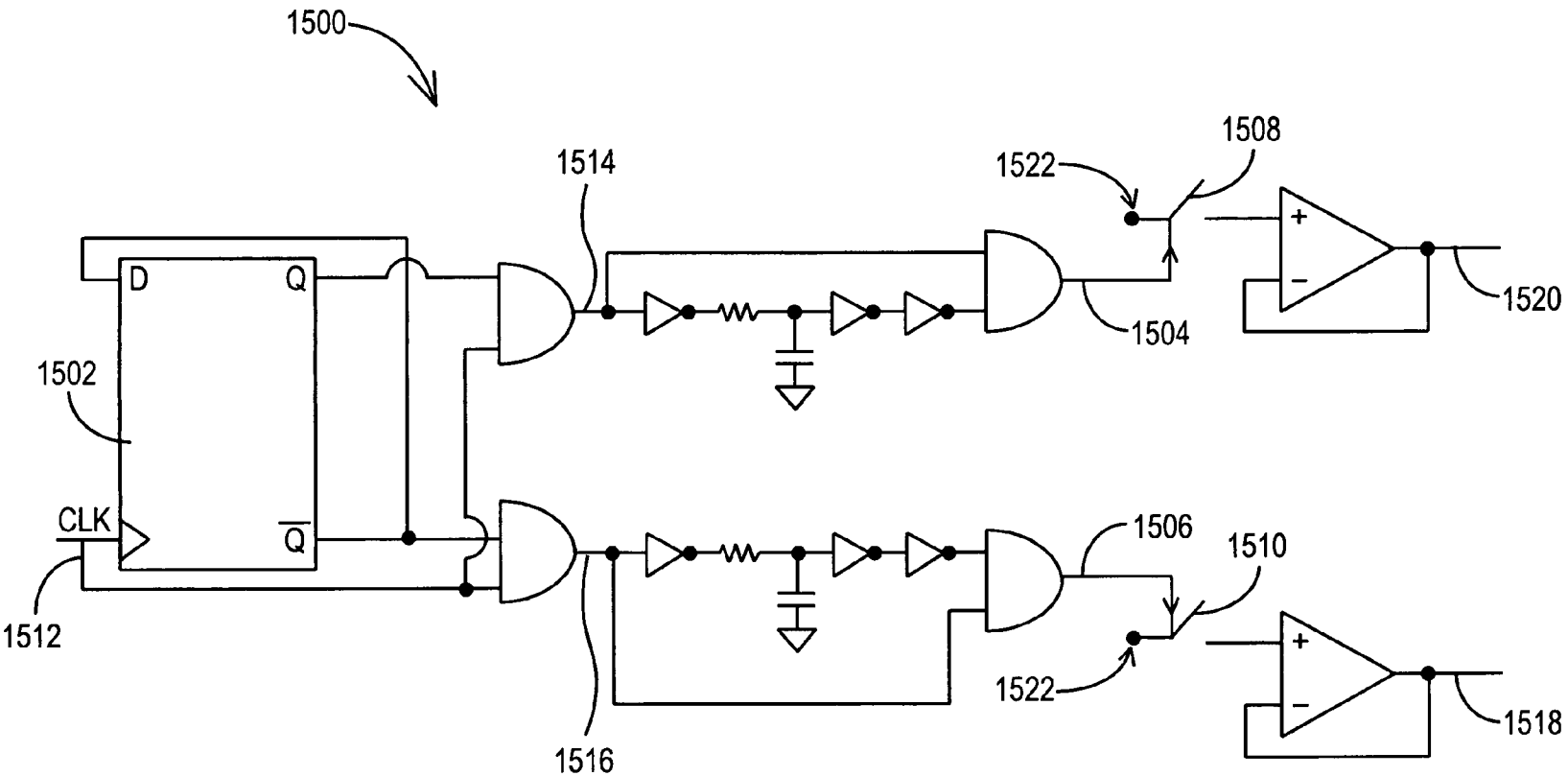
FIG. 15A depicts exemplary circuitry according to an embodiment.
Figure 15B:
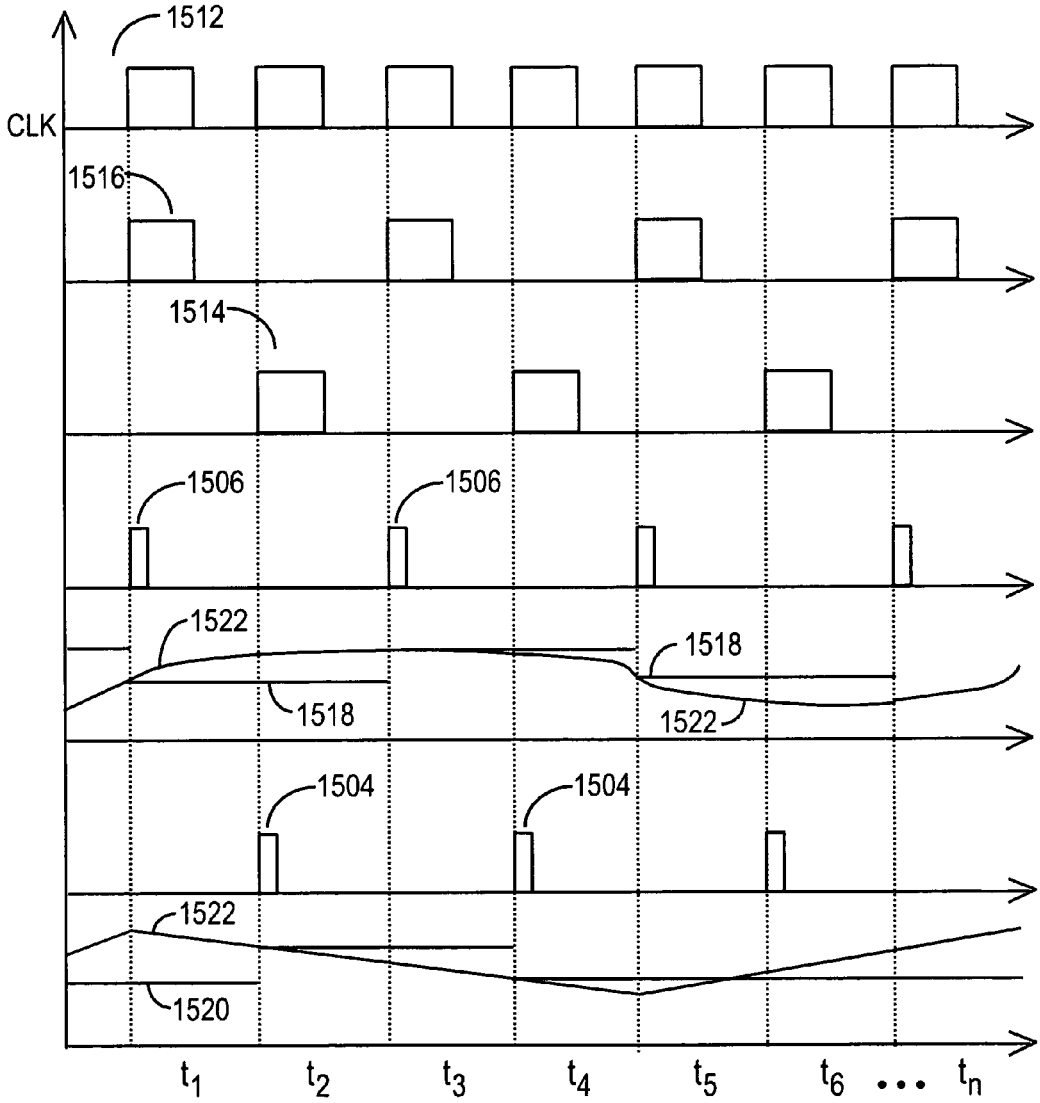
FIG. 15B depicts an exemplary timing diagram of the circuitry of FIG. 15A.

To that end, in a single sensor embodiment, the controller (302, 402) may comprise multiplexing circuitry which may be capable of permitting the controller to utilize ambient light in one time interval and panel brightness in another time interval. Of course, the controller can receive light signals from both ambient light and panel brightness in an alternating fashion, which may include a fixed and/or programmable time interval for each light signal. Exemplary multiplexing circuitry 1500 is depicted in FIG. 15A. Described in conjunction with an exemplary timing diagram depicted in FIG. 15B, a flip flop circuit 1502 may be provided that receives a clock signal 1512 and may generate a rectangular signal 1516 in a first time period (t1) and a second rectangular signal 1514 in a second time period. A first switch control signal 1506 may be generated to control the operation of a first switch 1510. A second switch control signal 1504 may be generated to control the operation of a second switch 1508. A light source signal 1522 may be provided as an input to switches 1510 and 1508. Since switch control signals 1506 and 1504 operate in alternate time intervals, an ambient light signal 1518 may be generated at one output during a first time interval, and a panel display brightness signal 1520 may be generated at another output during a second time interval.

Thus, in summary, one embodiment described herein provides a controller capable of receiving, at least in part, a brightness level signal indicative of a brightness level of a display. The controller is also capable of controlling the brightness of the display, based at least in part on the brightness level signal.

A system embodiment described herein may include a display and a controller capable of receiving, at least in part, a brightness level signal indicative of a brightness level of the display. The controller is also capable of controlling the brightness of the display, based at least in part on the brightness level signal.

A module embodiment may include a controller capable of receiving, at least in part, a brightness level signal indicative of a brightness level of a display and further capable of generating a control signal indicative of the brightness level. The module may also include power supply circuitry capable of receiving the control signal from the controller and further capable of delivering power to the display, based at least in part on the control signal.

Another apparatus embodiment may include a sensor capable of generating a first signal indicative of a display brightness level in a first time period, and a second signal indicative of an ambient light level in a second time period, and a controller capable of receiving the first and second signals, and further capable of controlling the brightness of the display based on at least one of the first and second signals.

Advantageously, the embodiments described herein may utilize a "closed-loop" control scheme where panel brightness is used as negative feedback information in a controlling the brightness level of a display. Further advantageously, in some embodiment described herein, a single sensor may be used to generate both ambient light signals and panel brightness signals. In such an embodiment, a controller may be capable of multiplexing these signals in time intervals to control the brightness of the display based on both feedback signals.

Those skilled in the art will recognize numerous modifications that may be made to the present invention, all of which are deemed within the spirit and scope defined herein, only as limited by the claims.

The invention claimed is:

1. An apparatus for controlling a brightness level of a display, comprising:

a display brightness sensor for sensing light substantially directly emitted from said display and for generating a brightness level signal indicative of said brightness level of said display;

an ambient light sensor for generating an ambient light signal indicative of ambient light in the vicinity of said display; and a controller coupled to said display brightness sensor and said ambient light sensor and for comparing said brightness level signal with said ambient light signal and controlling said brightness level of said display based on said comparison, wherein said controller further receives a default brightness signal indicating a default brightness of said display, provides a threshold level based on said default brightness signal, and limits a variation range of said brightness level of said display according to said threshold level.

2. The apparatus of claim 1, further comprising:

an inverter power supply configured to generate a controllable power signal to said display, wherein said inverter power supply is controlled by said controller.

3. The apparatus of claim 1, wherein said display is selected from the group consisting of an LCD panel, a plasma display, a field emission display and a light emitting diode display.

4. A system, comprising:

a display;

a display brightness sensor for sensing light substantially directly emitted from said display and for generating a brightness level signal indicative of a brightness level of said display;

an ambient light sensor for generating an ambient light signal indicative of ambient light in the vicinity of said display; and a controller coupled to said display brightness sensor and said ambient light sensor and for comparing said brightness level signal with said ambient light signal and controlling said brightness level of said display based on said comparison, wherein said controller further receives a default brightness signal indicating a default brightness level of said display, provides a threshold level based on said default brightness signal, and limits a variation range of said brightness level of said display according to said threshold level.

5. The system of claim 4, further comprising:

an inverter power supply configured to generate a controllable power signal to said display, wherein said inverter power supply is controlled by said controller.

6. The system of claim 4, wherein said display is selected from the group consisting of an LCD panel, a plasma display, a field emission display and a light emitting diode display.

7. A method, comprising:

generating a brightness level signal indicative of a display brightness level of a display by a display brightness sensor configured to sense light substantially directly emitted from said display;

generating an ambient light signal indicative of ambient light in the vicinity of said display;

comparing said brightness level signal indicative of said display brightness level with said ambient light signal;

generating a control signal according to said comparison;

controlling said brightness level of said display based on said control signal;

providing a threshold level based on a default brightness signal indicating a default brightness level of said display; and limiting a variation range of said brightness level of said display according to said threshold level.

8. An apparatus, comprising:

a sensor for sensing panel light substantially directly emitted from a display, for sensing ambient light in the vicinity of said display, for generating a brightness level signal indicative of a brightness level of said display based on said panel light, and for generating an ambient light signal indicative of said ambient light; and a controller coupled to said sensor and for comparing said brightness level signal with said ambient light signal and for controlling said brightness level of said display based on said comparison, wherein said controller further receives a default brightness signal indicating a default brightness level of said display, provides a threshold level based on said default brightness signal, and limits a variation range of said brightness level of said display according to said threshold level.

9. The apparatus of claim 8, further comprising:

a micro-electro-mechanical system (MEMS) comprising a mirror configured to reflect said panel light into said sensor during a first time period, and configured to reflect said ambient light into said sensor during a second time period.

10. The apparatus of claim 9, further comprising:

a MEMS controller configured to flex said mirror to receive said panel light during said first time period and said ambient light during said second time period.

11. The apparatus of claim 8, further comprising:

a light switch configured to switch between an ambient light source and a panel brightness source, and configured to transmit said panel light to said sensor during a first time interval, and configured to transmit said ambient light to said sensor during a second time interval.

12. The apparatus of claim 1, wherein said controller further receives a feedback signal from said display indicative of power of said display and further adjusts said control signal based on said feedback signal.

13. The system of claim 4, further comprising:

a power supply circuit coupled to said controller and for adjusting power to said display according to said control signal.

14. The system of claim 13, wherein said power supply circuit comprises a DC/AC inverter for providing power to said display.

15. The system of claim 4, wherein said controller further receives a feedback signal from said display indicative of power of said display and further adjusts said control signal based on said feedback signal.

16. The method of claim 7, further comprising:

receiving a feedback signal from said display indicative of power of said display; and adjusting said control signal based on said feedback signal.

17. The apparatus of claim 8, further comprising:

an inverter power supply configured to generate a controllable power signal to said display, wherein said inverter power supply is controlled by said controller.

18. The apparatus of claim 1, further comprising:

a mirror configured to reflect panel light into said display brightness sensor during a first time period, and configured to reflect said ambient light into said ambient light sensor during a second time period.

* * * * *